US011034907B2

(12) United States Patent
Aoki

(10) Patent No.: US 11,034,907 B2
(45) Date of Patent: Jun. 15, 2021

(54) TURBINE OIL, AND METHOD FOR USING TURBINE OIL

(71) Applicant: IDEMITSU KOSAN CO., LTD., Chiyoda-ku (JP)

(72) Inventor: Shinji Aoki, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/491,052

(22) PCT Filed: Mar. 8, 2018

(86) PCT No.: PCT/JP2018/008941

§ 371 (c)(1),
(2) Date: Sep. 4, 2019

(87) PCT Pub. No.: WO2018/164218

PCT Pub. Date: Sep. 13, 2018

(65) Prior Publication Data

US 2020/0017791 A1 Jan. 16, 2020

(30) Foreign Application Priority Data

Mar. 8, 2017 (JP) ..... JP2017-044352

(51) Int. Cl.

| | |
|---|---|
| ***C10M 105/38*** | (2006.01) |
| ***C10M 127/06*** | (2006.01) |
| ***C10M 133/12*** | (2006.01) |
| ***C10M 145/14*** | (2006.01) |
| ***C10M 169/04*** | (2006.01) |
| *C10N 20/04* | (2006.01) |
| *C10N 40/13* | (2006.01) |
| *C10N 30/02* | (2006.01) |

(52) U.S. Cl.

CPC ..... *C10M 105/38* (2013.01); *C10M 127/06* (2013.01); *C10M 133/12* (2013.01); *C10M 145/14* (2013.01); *C10M 169/04* (2013.01); *C10N 2020/04* (2013.01); *C10N 2030/02* (2013.01); *C10N 2040/13* (2013.01)

(58) Field of Classification Search

CPC ..... C10M 133/12; C10M 169/04; C10M 145/14; C10M 105/38; C10M 127/06; C10N 2030/02; C10N 2020/04; C10N 2040/13

See application file for complete search history.

(56) References Cited

U.S. PATENT DOCUMENTS

| | | | | |
|---|---|---|---|---|
| 5,160,647 | A | 11/1992 | Odorisio et al. | |
| 5,698,502 | A | 12/1997 | Pafford et al. | |
| 2011/0034358 | A1* | 2/2011 | Komatsubara | C10M 169/04 508/459 |
| 2012/0028861 | A1 | 2/2012 | Douglas et al. | |
| 2012/0135904 | A1* | 5/2012 | Kamano | C10M 135/10 508/548 |
| 2014/0179574 | A1* | 6/2014 | Seddon | C10M 133/44 508/297 |

FOREIGN PATENT DOCUMENTS

| | | | |
|---|---|---|---|
| EP | 2 055 763 | A1 | 5/2009 |
| JP | 48-91462 | | 11/1973 |
| JP | 5-194331 | A | 8/1993 |
| JP | 11-5988 | A | 1/1999 |
| JP | 2001-501991 | A | 2/2001 |
| JP | 2002-3878 | A | 1/2002 |
| JP | 2004-277712 | A | 10/2004 |
| JP | 2005-194416 | A | 7/2005 |
| JP | 2005-325241 | A | 11/2005 |
| JP | 2014/523471 | | 9/2014 |
| WO | WO 2010147016 | | 12/2010 |

OTHER PUBLICATIONS

International Search Report dated Jun. 12, 2018 in PCT/JP2018/008941 filed on Mar. 8, 2018.
Extended European Search Report dated Aug. 17, 2020 in Patent Application No. 18763625.3, 6 pages.
Office Action dated Nov. 10, 2020, in JP Application No. 2017-044352 w/ English translation, (7 pages).

* cited by examiner

*Primary Examiner* — Vishal V Vasisth
(74) *Attorney, Agent, or Firm* — Oblon, McClelland, Maier & Neustadt, L.L.P.

(57) ABSTRACT

A turbine oil used in a turbine of a jet engine, containing: a base oil (A) containing a polyol ester (A1); an antioxidant (B) containing an amine-based antioxidant (B1); a polymethacrylate (C) having a weight average molecular weight of 50,000 to 600,000; and an alkyl aromatic compound (D), having a content of the component (D) of 1,000 parts by mass or less per 100 parts by mass of a total resin content of the component (C), and satisfying the following requirements (1) and (2): requirement (1): a viscosity index of 140 or more; and requirement (2): a coking amount attached to a panel of 80 mg or less after a panel coking test under the prescribed condition. The turbine oil has a high viscosity index to such an extent that an oil film can be retained in the use under a high temperature environment as in a turbine of a jet engine mounted on an aircraft, and is excellent in low temperature viscosity characteristics while retaining excellent heat resistance.

10 Claims, No Drawings

TURBINE OIL, AND METHOD FOR USING TURBINE OIL

This application is a 371 of PCT/JP2018/008941, filed Ser. No. 03/082,018.

TECHNICAL FIELD

The present invention relates to a turbine oil used in a turbine of a jet engine, and a method for using the turbine oil.

BACKGROUND ART

In association with the enhancement in performance and efficiency of machinery equipments, power equipments, and the like due to the technical progress thereof in recent years, there has been a demand of a lubricating oil composition capable of withstanding severe use conditions. For example, a turbine of a jet engine mounted on an aircraft becomes considerably high temperature. A lubricating oil composition used in the turbine (i.e., a turbine oil) necessarily has high heat resistance.

For example, PTL 1 describes a lubricating oil composition prepared by blending an amine-based antioxidant, a phosphate ester, and an acidic phosphate ester amine salt in the prescribed amounts to a base oil formed of a polyphenyl ether and/or a polyphenyl thioether each having 3 to 5 aromatic rings.

According to PTL 1, the lubricating oil composition is said to have heat resistance that satisfies the requirement standard of the United States Military Standard MIL-PRF-87100A as a lubricating oil for a jet engine.

CITATION LIST

Patent Literature

PTL 1: JP 2002-003878 A

SUMMARY OF INVENTION

Technical Problem

A turbine oil used in a turbine of a jet engine mounted on an aircraft is demanded to have not only heat resistance, but also a high viscosity index to such an extent that a viscosity of a certain level or higher can be maintained to retain an oil film under a high temperature environment.

PTL 1 does not have any description relating to the viscosity index of the lubricating oil composition. However, the kinematic viscosity values at 40° C. and 100° C. of the lubricating oil composition shown as Example 1 of PTL 1 are described, and the viscosity index calculated from these values is "approximately 61", which is a significantly low value.

Accordingly, the lubricating oil composition described in PTL 1 tends to vary in viscosity depending on the temperature environment, and as estimated from the kinematic viscosity values at 40° C. and 100° C., it is considered that an oil film is difficult to retain due to the decrease of the viscosity in the use under a high temperature condition as in a turbine of a jet engine.

In a turbine oil that is applied to ordinary purposes, a viscosity index improver, which is a polymer, may be blended for enhancing the viscosity index in some cases.

However, it is considered that the presence of a polymer used as a viscosity index improver causes the decrease of the heat resistance of the turbine oil. Specifically, in the use of the turbine oil containing the polymer under a high temperature environment, there is a problem that coking and deposits occur due to the polymer, and adhere to the members of the turbine to cause operational malfunction.

The present invention has been made in view of the aforementioned problem, and an object thereof is to provide a turbine oil that has a high viscosity index to such an extent that an oil film can be retained in the use under a high temperature environment as in a turbine of a jet engine mounted on an aircraft, and is excellent in low temperature viscosity characteristics while retaining excellent heat resistance, and a method for using the turbine oil.

Solution to Problem

The present inventor has found that the problem can be solved by a turbine oil that contains a base oil containing a polyol ester, an amine-based antioxidant, a polymethacrylate, and an alkyl aromatic compound, and also contains a polymethacrylate having a particular molecular weight and an alkyl aromatic compound in a particular content ratio, and thus the present invention has been completed.

The present invention provides the following items [1] and [2].

[1] A turbine oil used in a turbine of a jet engine, containing: a base oil (A) containing a polyol ester (A1); an antioxidant (B) containing an amine-based antioxidant (B1); a polymethacrylate (C) having a weight average molecular weight of 50,000 to 600,000; and an alkyl aromatic compound (D), having a content of the component (D) of 250 parts by mass or less per 100 parts by mass of a total resin content of the component (C), and satisfying the following requirements (1) and (2);

requirement (1); a viscosity index of 140 or more; and requirement (2); a coking amount attached to a panel of 80 mg or less after continuously performing a panel coking test for 6 hours according to Fed. Test Method Std. 791-3462 under the condition of a panel temperature of 320° C. and an oil temperature of 130° C., and in a cycle of a splash time of 15 seconds and a suspend time of 30 seconds.

[2] A method of use of a turbine oil, including using a turbine oil for lubricating a turbine of a jet engine, the turbine oil containing; a base oil (A) containing a polyol ester (A1); an antioxidant (B) containing an amine-based antioxidant (B1); a polymethacrylate (C) having a weight average molecular weight of 50,000 to 600,000; and an alkyl aromatic compound (D), having a content of the component (D) of 250 parts by mass or less per 100 parts by mass of a total resin content of the component (C), and satisfying the following requirements (1) and (2):

requirement (1): a viscosity index of 140 or more; and requirement (2): a coking amount of 80 mg or less after continuously performing a panel coking test for 6 hours according to Fed. Test Method Std. 791-3462 under the condition of a panel temperature of 320° C. and an oil temperature of 130° C., and in a cycle of a splash time of 15 seconds and a suspend time of 30 seconds.

Advantageous Effects of Invention

The turbine oil of the present invention has a high viscosity index to such an extent that an oil film can be retained in the use under a high temperature environment as in a turbine of a jet engine mounted on an aircraft, and is excellent in low temperature viscosity characteristics while retaining excellent heat resistance.

DESCRIPTION OF EMBODIMENTS

In the description herein, the kinematic viscosity and the viscosity index mean values that are measured or calculated according to JIS K2283.

[Turbine Oil]

The turbine oil of the present invention contains; a base oil (A) containing a polyol ester (A1); an antioxidant (B) containing an amine-based antioxidant (B1); a polymethacrylate (C) having a weight average molecular weight of 50,000 to 600,000; and an alkyl aromatic compound (D).

The turbine oil of the present invention satisfies the following requirements (1) and (2), and is used in a turbine of a jet engine:

requirement (1); a viscosity index of 140 or more; and requirement (2); a coking amount attached to a panel of 80 mg or less after continuously performing a panel coking test for 6 hours according to Fed. Test Method Std. 791-3462 under condition of a panel temperature of 320° C. and an oil temperature of 130° C., and in a cycle of a splash time of 15 seconds and a suspend time of 30 seconds.

The turbine oil of the present invention has a high viscosity index as defined by the requirement (1), and therefore can retain an oil film even in the case where the turbine oil is used under a high temperature environment as in a turbine of a jet engine mounted on an aircraft. Specifically, in the case where the viscosity index of the turbine oil is less than 140, it is considered that an oil film is difficult to retain due to the decrease of the viscosity in the use under a high temperature condition as in a turbine of a jet engine.

In this standpoint, the viscosity index of the turbine oil of the present invention is 140 or more, preferably 155 or more, more preferably 170 or more, further preferably 180 or more, and still further preferably 190 or more.

For providing the high viscosity index as defined by the requirement (1), in general, a polymer having a function of a viscosity index improver is frequently blended.

However, as described above, the polymer used as a viscosity index improver may be a factor causing coking and deposits that may be formed in the turbine oil in the use under a high temperature environment, and the coking and deposits may be a factor causing operational malfunction.

Accordingly, it is the ordinary knowledge that a viscosity index improver, which may be a factor of the coking and the like causing operational malfunction, is principally not added to a turbine oil used in a turbine of a jet engine mounted on an aircraft.

Under the circumstances, the present inventor has made earnest investigations on an optimum formulation of a turbine oil that is capable of suppressing the coking and the like formed in the use under a high temperature environment as in a turbine of a jet engine, in the case where the polymethacrylate (C) having a weight average molecular weight of 50,000 to 600,000 is used as a viscosity index improver.

As a result, it has been found that the formation of coking caused by the polymethacrylate (C) can be effectively suppressed by using the polyol ester (A1) as a base oil, and using the amine-based antioxidant (B1) as an antioxidant.

Furthermore, it has also been found that the formation of coking can be further effectively suppressed by adding the alkyl aromatic compound (D) in the prescribed amount with respect to the polymethacrylate (C).

Consequently, the turbine oil of the present invention contains, along with the polymethacrylate (C), a combination of the polyol ester (A1), the amine-based antioxidant (B1), and the alkyl aromatic compound (D), and thereby the coking amount can be suppressed to satisfy the requirement (2) while achieving a high viscosity index as defined by the requirement (1).

In the turbine oil of one embodiment of the present invention, the coking amount defined by the requirement (2) is 80 mg or less, and is preferably 55 mg or less, more preferably 50 mg or less, further preferably 45 mg or less, and still further preferably 40 mg or less, from the standpoint of the suppression of the operational malfunction of the turbine.

The turbine oil of one embodiment of the present invention preferably has a kinematic viscosity at 100° C. of 5.0 to 15.0 $mm^2/s$, more preferably from 6.5 to 13.0 $mm^2/s$, further preferably from 7.5 to 12.0 $mm^2/s$, and still further preferably from 8.5 to 11.0 $mm^2/s$.

The turbine oil of one embodiment of the present invention preferably has a BF viscosity (Brookfield viscosity) at −40° C. of 25,000 mPa·s or less, more preferably 23,000 mPa·s or less, further preferably 21,000 mPa·s or less, and still further preferably 20,000 mPa·s or less, and is generally 9,000 mPa·s or more, from the standpoint of the production of the turbine oil excellent in low temperature viscosity characteristics.

In the description herein, the BF viscosity means a value that is measured according to the method described in ASTM D2983.

The turbine oil of one embodiment of the present invention may further contain additional additives other than the components (B) to (D) within a range not impairing the effects of the present invention.

In the turbine oil of one embodiment of the present invention, the total content of the components (A), (B), (C), and (D) is preferably from 70 to 100% by mass, more preferably from 80 to 100% by mass, further preferably from 90 to 100% by mass, and still further preferably from 95 to 100% by mass, based on the total amount (100% by mass) of the turbine oil.

The components contained in the turbine oil of one embodiment of the present invention will be described below.

<Base Oil (A)>

The turbine oil of the present invention contains a base oil (A) containing a polyol ester (A1).

The use of the base oil (A) containing a polyol ester (A1) provides a turbine oil that can readily retain an oil film formed under a high temperature environment while achieving good low temperature viscosity characteristics, and is further enhanced in heat resistance.

The base oil (A) used in one embodiment of the present invention may contain a synthetic oil other than the component (A1) within a range not impairing the effects of the present invention.

In the turbine oil of one embodiment of the present invention, the content ratio of the polyol ester (A1) in the component (A) is preferably from 70 to 100% by mass, more preferably from 80 to 100% by mass, further preferably from 90 to 100% by mass, and still further preferably from 95 to 100% by mass, based on the total amount (100% by mass) of the component (A).

The base oil (A) used in one embodiment of the present invention preferably has a kinematic viscosity at 100° C. of 3.0 to 8.0 $mm^2/s$, more preferably from 3.5 to 7.0 $mm^2/s$, further preferably from 4.0 to 6.0 $mm^2/s$, and still further preferably from 4.5 to 5.5 $mm^2/s$.

The base oil (A) used in one embodiment of the present invention preferably has a viscosity index of 90 or more, more preferably 100 or more, further preferably 110 or more, and still further preferably 120 or more.

In the turbine oil of one embodiment of the present invention, the content of the base oil (A) is preferably 60% by mass or more, more preferably 65% by mass or more, further preferably 70% by mass or more, and still further preferably 75% by mass or more, and is preferably 95% by mass or less, more preferably 92% by mass or less, and further preferably 90% by mass or less, based on the total amount (100% by mass) of the turbine oil.

[Polyol Ester (A1)]

Examples of the polyol ester (A1) used in one embodiment of the present invention include a hindered ester that is an ester of a hindered polyol having one or more quaternary carbon atoms in the molecule and from 1 to 4 methylol group bonded to at least one of the quaternary carbon atoms, with an aliphatic monocarboxylic acid.

The polyol ester (A1) may be used alone or as a combination of two or more kinds thereof.

The polyol ester (A1) is generally a complete ester in which all the hydroxy groups of the polyol have been esterified, and may contain a small amount of a partial ester having a part of hydroxy groups remaining unesterified, within a range not impairing the effects of the present invention.

The hindered polyol as a raw material of the polyol ester (A1) is preferably a compound represented by the following general formula (a-1).

(a-1)

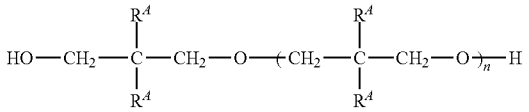

In the general formula (a-1), $R^A$ each independently represent a monovalent hydrocarbon group having 1 to 6 carbon atoms or a methylol group (—$CH_2OH$).

n represents an integer of 0 to 4, preferably from 0 to 2, more preferably from 0 to 1, and further preferably 0. The case of n=0 means a single bond, and the compound is a compound represented by the following general formula (a-1').

(a-1')

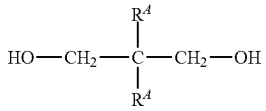

In the general formula (a-1'), $R^A$ each independently represent a monovalent hydrocarbon group having 1 to 6 carbon atoms or a methylol group (—$CH_2OH$).

Examples of the monovalent hydrocarbon group having 1 to 6 carbon atoms that can be selected as $R^A$ include an alkyl group having 1 to 6 carbon atoms (such as a methyl group, an ethyl group, a propyl group, a butyl group, a pentyl group, and a hexyl group), a cyclopentyl group, a cyclohexyl group, and a phenyl group.

The aforementioned alkyl group may be a linear alkyl group or a branched alkyl group.

Among these, the monovalent hydrocarbon group having 1 to 6 carbon atoms that can be selected as $R^A$ is preferably an alkyl group having 1 to 6 carbon atoms, and more preferably an alkyl group having 1 to 3 carbon atoms.

Specific examples of the compound represented by the general formula (a-1) include a hindered polyol, such as a dialkylpropanediol (wherein the alkyl group has 1 to 6 carbon atoms), a trimethylolaklane (wherein the alkane has 2 to 7 carbon atoms), pentaerythritol, and a dehydration condensate of these compounds, and more specific examples thereof include neopentyl glycol, 2-ethyl-2-methyl-1,3-propanediol, 2,2-diethyl-1,3-prop anediol, trimethylolethane, trimethylolpropane, trimethylolbutane, trimethylolpentane, trimethylolhexane, trimethylolheptane, pentaerythritol, 2,2,6,6-tetramethyl-4-oxa-1,7-heptanediol, 2,2,6,6,10,10-hexamethyl-4,8-dioxa-1,11-undecanediol, 2,2,6,6,10,10,14,14-octamethyl-4,8,12-trioxa-1,15-pentadecanediol, 2,6-di(hydroxymethyl)-2,6-trimethyl-4-oxa-1,7-heptanediol, 2,6,10-tri(hydroxymethyl)-2,6,10-trimethyl-4,8-dioxa-1,11-undecanediol, 2,6,10,14-tetra(hydroxymethyl)-2,6,10,14-tetramethyl-4,8,12-trioxa-1,15-pentadec anediol, di(pentaerythritol), tri(pentaerythritol), tetra(pentaerythritol), and penta(pentaerythritol).

Among these, trimethylolpropane, neopentyl glycol, pentaerythritol, and a dehydration condensate of two molecules or three molecules thereof are preferred, trimethylolpropane, neopentyl glycol, and pentaerythritol are more preferred, and pentaerythritol is further preferred.

Examples of the aliphatic monocarboxylic acid as a raw material of the polyol ester (A1) include a saturated aliphatic monocarboxylic acid having 5 to 22 carbon atoms.

An acyl group of the saturated aliphatic monocarboxylic acid may be linear or branched.

Examples of the saturated aliphatic monocarboxylic acid include a linear saturated monocarboxylic acid, such as valeric acid, caproic acid, enanthic acid, caprylic acid, pelargonic acid, capric acid, undecanoic acid, lauric acid, tridecanoic acid, myristic acid, pentadecanoic acid, palmitic acid, heptadecanoic acid, stearic acid, nonadecanoic acid, arachic acid, and behenic acid; and a branched saturated monocarboxylic acid, such as isomyristic acid, isopalmitic acid, isostearic acid, 2,2-dimethylpropanoic acid, 2,2-dimethylbutanoic acid, 2,2-dimethylpentanoic acid, 2,2-dimethyloctanoic acid, 2-ethyl-2,3,3-trimethylbutanoic acid, 2,2,3,4-tetramethylpentanoic acid, 2,5,5-trimethyl-2-t-butylhexanoic acid, 2,3,3-trimethyl-2-ethylbutanoic acid, 2,3-dimethyl-2-isopropylbutanoic acid, 2-ethylhexanoic acid, and 3,5,5-trimethylhexanoic acid.

These aliphatic monocarboxylic acids may be used alone or as a mixture of two or more kinds thereof in the esterification.

The number of carbon atoms of the saturated aliphatic monocarboxylic acid is preferably from 4 to 18, more preferably from 5 to 14, and further preferably from 5 to 10.

The polyol ester (A1) used in one embodiment of the present invention preferably has a kinematic viscosity at 100° C. of 3.0 to 8.0 $mm^2/s$, more preferably from 3.5 to 7.0 $mm^2/s$, further preferably from 4.0 to 6.0 $mm^2/s$, and still further preferably from 4.5 to 5.5 $mm^2/s$.

The polyol ester (A1) used in one embodiment of the present invention preferably has a viscosity index of 90 or more, more preferably 100 or more, further preferably 110 or more, and still further preferably 120 or more.

The polyol ester (A1) used in one embodiment of the present invention preferably has a number average molecular weight (Mn) of 100 to 8,000, more preferably from 200 to 4,000, further preferably from 300 to 2,000, and still further preferably from 400 to 1,000.

[Base Oil Other than Component (A1)]

The turbine oil of one embodiment of the present invention may contain a synthetic oil other than the component (A1) as the base oil (A) within a range not impairing the effects of the present invention.

Examples of the synthetic oil other than the component (A1) include various esters other than the component (A1), such as a dibasic acid ester (e.g., ditridecyl glutarate), a tribasic acid ester (e.g., 2-ethylhexyl trimellitate), and a phosphate ester; and various ethers, such as a polyalkylene glycol and a polyphenyl ether.

In the turbine oil of one embodiment of the present invention, the content of a mineral oil is preferably small.

This is because a mineral oil contains wax, and the wax component may be deposited under a low temperature environment to deteriorate the low temperature viscosity characteristics. Furthermore, in the use thereof under a high temperature environment as in a turbine of a jet engine, the retention of an oil film formed may be adversely affected thereby to cause a problem in heat resistance.

From the aforementioned standpoint, in the turbine oil of one embodiment of the present invention, the content of a mineral oil is preferably less than 10% by mass, more preferably less than 5% by mass, further preferably less than 1% by mass, and still further preferably less than 0.1% by mass, based on the total amount (100% by mass) of the component (A).

In the turbine oil of one embodiment of the present invention, the content of a poly-α-olefin is preferably small from the standpoint of the suppression of separation at low temperature.

Specifically, the content of a poly-α-olefin is preferably less than 10% by mass, more preferably less than 5% by mass, further preferably less than 1% by mass, and still further preferably less than 0.1% by mass, based on the total amount (100% by mass) of the component (A).

<Antioxidant (B)>

The turbine oil of the present invention contains an antioxidant (B) containing an amine-based antioxidant (B1).

The amine-based antioxidant (B1) contained may further enhance the oxidation stability due to the good solubility thereof in the polyol ester (A1), and thereby the turbine oil that satisfies the requirement (2) may be provided.

The antioxidant (B) used in one embodiment of the present invention may further contain an antioxidant other than the amine-based antioxidant (B1) within a range not impairing the effects of the present invention.

However, in the turbine oil of one embodiment of the present invention, the content ratio of the amine-based antioxidant (B1) in the component (B) is preferably from 30 to 100% by mass, more preferably from 50 to 100% by mass, further preferably from 60 to 100% by mass, and still further preferably from 70 to 100% by mass, based on the total amount (100% by mass) of the component (B).

In the turbine oil of one embodiment of the present invention, the content of the antioxidant (B) is preferably from 0.01 to 10% by mass, more preferably from 0.05 to 7% by mass, and further preferably from 0.1 to 5% by mass, based on the total amount (100% by mass) of the turbine oil.

[Amine-Based Antioxidant (B1)]

The amine-based antioxidant (B1) used in one embodiment of the present invention may be an amine compound that has an antioxidant capability, and examples thereof include a naphthylamine (B11) and a diphenylamine (B12).

The amine-based antioxidant (B1) may be used alone or as a combination of two or more kinds thereof.

In one embodiment of the present invention, it is preferred that both the naphthylamine (B11) and the diphenylamine (B12) are contained.

In the turbine oil of one embodiment of the present invention, the content ratio of the naphthylamine (B11) and the diphenylamine (B12) ((B11)/(B12)) by mass is preferably from 10/90 to 95/5, more preferably from 25/85 to 90/10, further preferably from 40/60 to 85/15, and still further preferably from 55/45 to 80/20.

Examples of the naphthylamine (B11) include phenyl-α-naphthylamine, phenyl-β-naphthylamine, alkylphenyl-α-naphthylamine, and alkylphenyl-β-naphthylamine, and alkylphenyl-α-naphthylamine is preferred.

The number of carbon atoms of the alkyl group of the alkylphenyl-α-naphthylamine is preferably from 1 to 30, and from the standpoint of the enhancement of the solubility in the base oil (A) and the further enhancement of the sludge suppression effect, is preferably from 1 to 20, more preferably from 4 to 16, further preferably from 6 to 14, and still further preferably from 6 to 10

The diphenylamine (B12) is preferably a compound represented by the following general formula (b-1), and more preferably a compound represented by the following general formula (b-2).

(b-1)

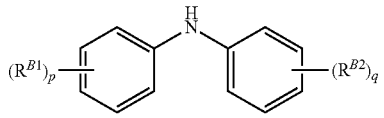

(b-2)

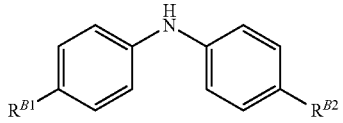

In the general formulae (b-1) and (b-2), $R^{B1}$ and $R^{B2}$ each independently represent an alkyl group having 1 to 30 carbon atoms, or an alkyl group having 1 to 30 carbon atoms substituted by an aryl group having 6 to 18 ring-forming atoms.

The alkyl group may be a linear alkyl group or a branched alkyl group.

In the general formula (b-1), p and q each independently represent an integer of 0 to 5, and is preferably 0 or 1, and more preferably 1.

In the case where there are plural groups represented by each of $R^{B1}$ and $R^{B2}$, the plural groups represented by each of $R^{B1}$ and $R^{B2}$ may be the same as or different from each other.

The number of carbon atoms of the alkyl group that can be selected as $R^{B1}$ and $R^{B2}$ is from 1 to 30, preferably from 1 to 20, and more preferably from 1 to 10.

Examples of the aryl group that can be substituted on the alkyl group include a phenyl group, a naphthyl group, and a biphenyl group, and a phenyl group is preferred.

Examples of the alkyl group of the alkylphenyl-naphthylamines and the alkyl group that the diphenylamine may have include a methyl group, an ethyl group, a propyl group, a butyl group, a pentyl group, a hexyl group, a heptyl group, an octyl group, a nonyl group, a decyl group, an undecyl group, a dodecyl group, a hexadecyl group, an octadecyl group, a nonadecyl group, an icosyl group, and a tetracosyl group.

In the turbine oil of one embodiment of the present invention, the content of the amine-based antioxidant (B1) in terms of nitrogen atom is preferably from 200 to 3,000 ppm by mass, more preferably from 500 to 2,500 ppm by mass, further preferably from 800 to 2,300 ppm by mass, and still further preferably from 1,000 to 2,000 ppm by mass, based on the total amount (100% by mass) of the turbine oil.

[Antioxidant other than Component (B)]

The turbine oil of one embodiment of the present invention may further contain an antioxidant other than the component (B1) as the antioxidant (B) within a range not impairing the effects of the present invention.

The antioxidant other than the component (B1) is preferably phenol-based antioxidant.

Examples of the phenol-based antioxidant include a monocyclic phenol compound, such as 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl)phenol, 2,6-di-t-amyl-4-methylphenol, and n-octadecyl-3-(3,5-di-t-butyl-4-hydroxyphenyl) propionate, and a polycyclic phenol compound, such as 4,4'-methylenebis(2,6-di-t-butylphenol), 4,4'-isopropylidenebis(2,6-di-t-butylphenol), 2,2'-methylenebis(4-methyl-6-t-butylphenol), 4,4'-bis(2,6-di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

In the turbine oil of one embodiment of the present invention, the content ratio of the phenol-based antioxidant is preferably from 0 to 100 parts by mass, more preferably from 0 to 60 parts by mass, and further preferably from 0 to 40 parts by mass, per 100 parts by mass of the amine-based antioxidant (B1).

<Polymethacrylate (C)>

The turbine oil of the present invention contains a polymethacrylate (C) having a weight average molecular weight of 50,000 to 600,000.

The polymethacrylate (C) may be either a non-dispersed polymethacrylate or a dispersed polymethacrylate, and a non-dispersed polymethacrylate is preferred.

Examples of the non-dispersed polymethacrylate include a polymer having a structural unit derived from an alkyl methacrylate having an alkyl group having 1 to 20 carbon atoms. The polymer may be a copolymer that further contains a structural unit derived from a monomer having a functional group, such as a hydroxy group and a carboxy group.

Examples of the dispersed polymethacrylate include a copolymer of methacrylate and a nitrogen-containing monomer having an ethylenic unsaturated bond.

Examples of the nitrogen-containing monomer include climethylaminomethyl methacrylate, diethylaminomethyl methacrylate, dimethylaminoethyl methacrylate, diethylaminoethyl methacrylate, 2-methyl-5-vinylpyridine, morpholinom ethyl methacrylate, morpholinoethyl methacrylate, N-vinylpyrrolidone, and mixtures thereof.

The polymethacrylate (C) has a weight average molecular weight (Mw) of 50,000 to 600,000, preferably from 100,000 to 550,000, more preferably from 150,000 to 500,000, and further preferably from 200,000 to 450,000, from the standpoint of the preparation of the turbine oil that satisfies the requirement (1).

The polymethacrylate (C) preferably has a molecular weight distribution (Mw/Mn) (wherein Mn represents the number average molecular weight) of 4.0 or less, more preferably 3.7 or less, and further preferably 3.5 or less, and is generally 1.01 or more, from the standpoint of the preparation of the turbine oil that satisfies the requirement (1).

In the description herein, the weight average molecular weight (Mw) and the number average molecular weight (Mn) of the component (C) are standard polystyrene conversion values measured by the gel permeation chromatography (GPC) method, and specifically mean values that are measured under the measurement condition described in the examples later.

In the turbine oil of one embodiment of the present invention, the content of the polymethacrylate (C) in terms of resin content is preferably from 0.1 to 10.0% by mass, more preferably from 0.3 to 7.0% by mass, further preferably from 0.5 to 5.0% by mass, and still further preferably from 0.8 to 3.5% by mass, based on the total amount (100% by mass) of the turbine oil.

The polymethacrylate (C) is commercially available in the form of a solution dissolved in a diluent oil in many cases in consideration of the handleability and the solubility in the base oil (A).

The content of the component (C) including the diluent oil is preferably from 4 to 15% by mass, more preferably from 4.5 to 13% by mass, and further preferably from 5 to 12% by mass, based on the total amount (100% by mass) of the turbine oil.

In the description herein, however, the "content of the polymethacrylate (C)" means the content of the resin component as the polymethacrylate and the diluent oil. The "content of the polymethacrylate (C) in terms of resin content means the content only of the resin content as the polymethacrylate except for the diluent oil.

The turbine oil of one embodiment of the present invention may contain a polymer component that does not correspond to the component (C) within a range not impairing the effects of the present invention.

Examples of the polymer component include a polymethacrylate having a weight average molecular weight of less than 50,000 used as a pour point depressant.

<Alkyl Aromatic Compound (D)>

The turbine oil of the present invention contains an alkyl aromatic compound (D).

The alkyl aromatic compound (D) may be an aromatic compound that has one or more alkyl group, and examples thereof include an alkylbenzene, an alkylnaphthalene, an alkylanthracene, an alkylphenanthrene, and an alkylbiphenyl.

The alkyl aromatic compound (D) may be used alone or as a combination of two or more kinds thereof.

The number of carbon atoms of the alkyl group is preferably from 1 to 40, more preferably from 1 to 35, and further preferably from 4 to 30.

The alkyl aromatic compound (D) used in one embodiment of the present invention preferably has a kinematic viscosity at 100° C. of 2.0 to 7.0 $mm^2/s$, more preferably from 2.5 to 6.0 $mm^2/s$, further preferably from 3.0 to 5.5 $mm^2/s$, and still further preferably from 3.5 to 5.2 $mm^2/s$.

The alkyl aromatic compound (D) used in one embodiment of the present invention preferably has a viscosity index of −50 to 120, more preferably from −45 to 100, further preferably from −40 to 90, and still further preferably from −38 to 85.

In the turbine oil of the present invention, the content of the alkyl aromatic compound (D) is 1,000 parts by mass or less per 100 parts by mass of the total resin content of the component (C).

In the case where the content exceeds 1,000 parts, the low temperature viscosity characteristics are significantly deteriorated, and the coking amount occurring under a high temperature environment is increased.

The content of the alkyl aromatic compound (D) is preferably 900 parts by mass or less, further preferably 800 parts by mass or less, still further preferably 700 parts by mass or less, and particularly preferably 600 parts by mass or less, per 100 parts by mass of the total resin content of the component (C), from the standpoint of the suppression of the deterioration of the low temperature viscosity characteristics and the preparation of the turbine oil that satisfies the requirement (2).

The content of the alkyl aromatic compound (D) is preferably 100 parts by mass or more, more preferably 110 parts by mass or more, further preferably 130 parts by mass or more, and still further preferably 150 parts by mass or more, per 100 parts by mass of the total resin content of the component (C), from the standpoint of the preparation of the turbine oil that satisfies the requirement (2).

In the turbine oil of one embodiment of the present invention, the content of the alkyl aromatic compound (D) is preferably from 0.1 to 17% by mass, more preferably from 1.5 to 15% by mass, further preferably from 2.0 to 13% by mass, and still further preferably from 2.5 to 11% by mass, based on the total amount (100% by mass) of the turbine oil, from the aforementioned standpoint.

<Additional Additives>

The turbine oil of one embodiment of the present invention may contain additional additives other than the components (B) to (D) within a range not impairing the effects of the present invention.

Examples of the additives include an extreme pressure agent, an anti-foaming agent, a friction modifier, an anti-wear agent, a rust inhibitor, and a metal deactivator.

These additives may be used alone or as a combination of two or more kinds thereof.

In the case where the additives are blended, the contents of the additives each may be controlled depending on the kinds of the additives within a range not impairing the effects of the present invention, and each are generally from 0.01 to 10% by mass, preferably from 0.05 to 5% by mass, and more preferably from 0.1 to 2% by mass, based on the total amount (100% by mass) of the turbine oil.

In the turbine oil of one embodiment of the present invention, the content of a metal atom-containing compound is preferably as small as possible from the standpoint of the preparation of the turbine oil that satisfies the requirement (2).

The metal atom of the "metal atom-containing compound" herein means an alkali metal atom, an alkaline earth metal atom, and a transition metal atom.

In the turbine oil of one embodiment of the present invention, the content of the metal atoms is preferably less than 100 ppm by mass, more preferably less than 50 ppm by mass, and further preferably less than 10 ppm by mass, based on the total amount (100% by mass) of the turbine oil, from the standpoint of the preparation of the turbine oil that satisfies the requirement (2).

In the description herein, the content of the metal atoms means a value that is measured according to JPI-5S-38-92.

In the turbine oil of one embodiment of the present invention, the content of an ashless dispersant is preferably as small as possible from the standpoint of the preparation of the turbine oil that satisfies the requirement (2).

In the turbine oil of one embodiment of the present invention, the content of the ashless dispersant is preferably less than 0.1% by mass, more preferably less than 0.01% by mass, and further preferably less than 0.001% by mass, based on the total amount (100% by mass) of the turbine oil.

Examples of the ashless dispersant herein include succinimide, a succinate ester, a benzylamine, and a polyamine.

[Production Method of Turbine Oil]

Examples of the production method of the turbine oil of the present invention include a production method including the following step (I).

Step (I); a step of blending the base oil (A) containing the polyol ester (A1), with the antioxidant (B) containing the amine-based antioxidant (B1); the polymethacrylate (C) having a weight average molecular weight of 50,000 to 600,000; and the alkyl aromatic compound (D).

In the step (I), additional additives other than the components (B) to (D) may be blended.

In the step (I), after blending the components, the components are preferably appropriately heated and sufficiently agitated.

The preferred structures of the compounds and the property values of the component (A) to (D), the blended amounts (contents) of the components, and the like are those described for the turbine oil above.

The turbine oil obtained through the step (I) satisfies the requirements (1) and (2), and the properties, the property values, and the like of the turbine oil other than the requirements are also those described above.

[Purpose and Use Method of Turbine Oil of Present Invention]

The turbine oil of the present invention has a high viscosity index to such an extent that an oil film can be retained in the use under a high temperature environment as in a turbine of a jet engine mounted on an aircraft, and is excellent in low temperature viscosity characteristics while retaining excellent heat resistance.

Accordingly, the turbine oil of the present invention is preferably used in a turbine of a jet engine mounted on an aircraft.

Therefore, the present invention can also provide a method for using a turbine oil shown below.

A method for using a turbine oil, including using a turbine oil for lubricating a turbine of a jet engine, the turbine oil containing: a base oil (A) containing a polyol ester (A1); an antioxidant (B) containing an amine-based antioxidant (B1); a polymethacrylate (C) having a weight average molecular weight of 50,000 to 600,000; and an alkyl aromatic compound (D), having a content of the component (D) of 250 parts by mass or less per 100 parts by mass of a total resin content of the component (C), satisfying the following requirements (1) and (2):

requirement (1): a viscosity index of 140 or more; and requirement (2): a coking amount of 80 mg or less after performing a panel coking test for 6 hours according to Fed. Test Method Std. 791-3462 under condition of a panel temperature of 320° C. and an oil temperature of 130° C., and in a cycle of a splash time of 15 seconds and a suspend time of 30 seconds.

In the method for using a turbine oil above, the preferred structures of the compounds and the property values of the components (A) to (D), the blended amounts (contents) of the components, and the like are those described for the turbine oil above, and the details of the requirements (1) and (2) that the turbine oil satisfies, and the properties, the property values, and the like of the turbine oil are also those described above.

The turbine oil of the present invention can be preferably applied, for example, to a lubricating oil for a turbomachine (e.g., a pump oil and a turbine oil) used for lubricating a pump, a vacuum pump, an air blower, a turbomachine, such as a turbo compressor, a steam turbine, a nuclear turbine, a gas turbine, and a turbine for hydroelectric power generation, and the like; a bearing oil and a gear oil used for lubricating a compressor, such as a rotary compressor and a reciprocating compressor, and a control system hydraulic oil used therefor; a hydraulic oil used in a hydraulic equipment; a lubricating oil for a machine tool used in a hydraulic unit of a machine tool; and the like, in addition to a turbine of a jet engine.

EXAMPLES

The present invention will be described more specifically with reference to examples below, but the present invention is not limited to the examples.

[Measurement Methods for Property Values]

(1) Kinematic Viscosity and Viscosity Index at 40° C. and 100° C.

The values were measured or calculated according to JIS K2283.

(2) Content of Metal Atoms

The values were measured according to JPI-5S-38-92.

(3) BF Viscosity at −40° C.

The values were measured according to ASTM D2983 (unit: mPa·s).

(4) Weight Average Molecular Weight (Mw)

The values were measured by using a gel permeation chromatography device ("HPLC Model 1260", produced by Agilent Technologies, Inc.) under the following condition, and a value measured in terms of standard polystyrene conversion was used.

(Measurement Condition)

Column: "Shodex LF404"×2 connected in series
Column temperature: 35° C.
Developing solvent: chloroform
Flow rate: 0.3 mL/min

Examples 1 to 4 and Comparative Examples 1 to 6

The base oil (A), the antioxidant (B), the polymethacrylate (C), the alkyl aromatic compound (D), and the additional additives were blended in the blended amounts shown in Table 1 and sufficiently mixed to prepare turbine oils.

The details of the base oil, the antioxidants, the polymethacrylates, the alkyl aromatic compounds, and the additional additives used in the preparation of the turbine oils are as follows.

<Base Oil (A)>

Polyol ester (a-1): pentaerythritol tetraester (complete ester of pentaerythritol and a saturated aliphatic monocarboxylic acid having 5 to 10 carbon atoms), kinematic viscosity at 40° C.: 23.41 $mm^2/s$, kinematic viscosity at 100° C.: 4.872 $mm^2/s$, viscosity index: 135

<Antioxidant (B)>

Amine-based antioxidant (b1-1) N-(octylphenyl)-α-naphthylamine, compound corresponding to the component (B11), nitrogen atom content: 4.2% by mass Amine-based antioxidant (b1-2): di(p-octylphenyl)amine, compound corresponding to the component (B12) represented by the general formula (b-2), wherein $R^{B1}$ and $R^{B2}$ represent octyl groups, nitrogen atom content: 3.6% by mass <Polymethacrylate (C)>

PMA (c-1): non-dispersed polymethacrylate, Mw: 200,000, Mw/Mn: 2.7, resin content: 28.2% by mass PMA (c-2): non-dispersed polymethacrylate, Mw: 420,000, Mw/Mn: 2.9, resin content: 30.5% by mass PMA (c-3): non-dispersed polymethacrylate, Mw: 380,000, Mw/Mn: 3.4, resin content: 16.5% by mass PMA (c-4): non-dispersed polymethacrylate, Mw: 400,000, Mw/Mn: 2.3, resin content: 20.1% by mass <Alkyl Aromatic Compound (D)>

Alkylbenzene (d-1): kinematic viscosity at 100° C.: 4.25 $mm^2/s$, viscosity index: −34

Alkylnaphthalene (d-2): kinematic viscosity at 100° C.: 4.75 $mm^2/s$, viscosity index: 77

<Additional Additives>

Additive mixture containing extreme pressure agent and metal deactivator

The turbine oils thus prepared each were measured or calculated for the kinematic viscosities at 40° C. and 100° C., the viscosity index, and the BF viscosity at −40° C. in the aforementioned methods, and measured for the coking amount by subjecting to the following panel coking test. The results are shown in Table 1.

[Panel Coking Test]

The test was performed continuously for 6 hours with a panel coking tester according to Fed. Test Method Std. 791-3462 under the condition of a panel temperature of 320° C. and an oil temperature of 130° C., and in a cycle of a splash time of 15 seconds and a suspend time of 30 seconds. After completing the test, the coking amount attached to the panel was measured. A smaller coking amount can be understood as a turbine oil with better heat resistance.

TABLE 1

| | | | | Example 1 | Example 2 | Example 3 | Example 4 | Comparative Example 1 | Comparative Example 2 |
|---|---|---|---|---|---|---|---|---|---|
| Composition | Base oil (A) | Polyol ester (a-1) | % by mass | 78.6 | 78.0 | 79.1 | 81.8 | 93.6 | 83.6 |
| | Antioxidant (B) | Amine antioxidant (b1-1) | % by mass | 2.3 | 2.3 | 2.3 | 2.3 | 2.3 | 2.3 |
| | | Amine antioxidant (b1-2) | % by mass | 1.5 | 1.5 | 1.5 | 1.5 | 1.5 | 1.5 |
| | Polymethacrylate (C) | PMA (c-1) | % by mass | 10.0 | | | | | 10.0 |
| | | PMA (c-2) | % by mass | | 5.6 | | | | |
| | | PMA (c-3) | % by mass | | | 9.5 | | | |
| | | PMA (c-4) | % by mass | | | | 6.8 | | |
| | Alkyl aromatic compound (D) | Alkylbenzene (d-1) | % by mass | 5.0 | 10.0 | 5.0 | | | |
| | | Alkylnaphthalene (d-2) | % by mass | | | | 5.0 | | |

TABLE 1-continued

| | | | | | | | | |
|---|---|---|---|---|---|---|---|---|
| Additional additives | Extreme pressure agent and metal deactivator | % by mass | 2.6 | 2.6 | 2.6 | 2.6 | 2.6 | 2.6 |
| — | Total | % by mass | 100.0 | 100.0 | 100.0 | 100.0 | 100.0 | 100.0 |
| Content of PMAs (c-1) to (c-4) in terms of resin content | | % by mass | 2.8 | 1.7 | 1.6 | 1.4 | — | 2.8 |
| Content of component (D) per 100 parts by mass of total resin content of component (C) | | part by mass | 178.6 | 585.5 | 319.0 | 365.8 | — | — |
| Content of metal atoms based on total amount of turbine oil | | ppm by mass | <10 | <10 | <10 | <10 | <10 | <10 |
| Content of ashless dispersant based on total amount of turbine oil | | % by mass | 0 | 0 | 0 | 0 | 0 | 0 |
| Properties of turbine oil | Kinematic viscosity at 40° C. | $mm^2/s$ | 53.2 | 51.3 | 48.7 | 45.2 | 25.9 | 50.9 |
| | Kinematic viscosity at 100° C. | $mm^2/s$ | 10.8 | 10.3 | 10.0 | 9.3 | 5.1 | 10.6 |
| | Viscosity index | — | 199 | 195 | 197 | 196 | 124 | 206 |
| | BF viscosity at −40° C. | mPa · s | 20,000 | 20,000 | 17,000 | 19,000 | 9,500 | 18,000 |
| Coking amount in panel coking test | | mg | 40 | 22 | 37 | 42 | 23 | 120 |

| | | | | Comparative Example 3 | Comparative Example 4 | Comparative Example 5 | Comparative Example 6 |
|---|---|---|---|---|---|---|---|
| Composition | Base oil (A) | Polyol ester (a-1) | % by mass | 88.0 | 84.1 | 85.6 | 68.0 |
| | Antioxidant (B) | Amine antioxidant (b1-1) | % by mass | 2.3 | 2.3 | 2.3 | 2.3 |
| | | Amine antioxidant (b1-2) | % by mass | 1.5 | 1.5 | 1.5 | 1.5 |
| | Polymethacrylate (C) | PMA (c-1) | % by mass | | | | |
| | | PMA (c-2) | % by mass | 5.6 | | | 5.6 |
| | | PMA (c-3) | % by mass | | 9.5 | | |
| | | PMA (c-4) | % by mass | | | 8.0 | |
| | Alkyl aromatic compound (D) | Alkylbenzene (d-1) | % by mass | | | | 20.0 |
| | | Alkylnaphthalene (d-2) | % by mass | | | | |
| | Additional additives | Extreme pressure agent and metal deactivator | % by mass | 2.6 | 2.6 | 2.6 | 2.6 |
| | — | Total | % by mass | 100.0 | 100.0 | 100.0 | 100.0 |
| Content of PMAs (c-1) to (c-4) in terms of resin content | | | % by mass | 1.7 | 1.6 | 1.6 | 1.7 |
| Content of component (D) per 100 parts by mass of total resin content of component (C) | | | part by mass | — | — | — | 1171.0 |
| Content of metal atoms based on total amount of turbine oil | | | ppm by mass | <10 | <10 | <10 | <10 |
| Content of ashless dispersant based on total amount of turbine oil | | | % by mass | 0 | 0 | 0 | 0 |
| Properties of turbine oil | Kinematic viscosity at 40° C. | | $mm^2/s$ | 48.8 | 47.9 | 48.6 | 53.3 |
| | Kinematic viscosity at 100° C. | | $mm^2/s$ | 10.2 | 10.0 | 10.1 | 10.3 |
| | Viscosity index | | — | 203 | 202 | 201 | 187 |
| | BF viscosity at −40° C. | | mPa · s | 19,000 | 15,000 | 19,000 | 32,000 |
| Coking amount in panel coking test | | | mg | 110 | 85 | 138 | 125 |

It is understood from Table 1 that the turbine oils prepared in Examples 1 to 4 each have a high viscosity index, are excellent in low temperature viscosity characteristics, have a small coking amount, and are good in heat resistance.

On the other hand, the turbine oil prepared in Comparative Example 1 does not contain a polymethacrylate, and thus has a low viscosity index, which raises a concern of insufficient oil film formation under a high temperature environment.

The turbine oils prepared in Comparative Examples 2 to 5 each have good viscosity characteristics, but have a larger coking amount than the turbine oils prepared in Examples, resulting in a problem in heat resistance.

The turbine oil prepared in Comparative Example 6 has a problem in heat resistance, and furthermore results in deteriorated low temperature viscosity characteristics.

The invention claimed is:

1. A turbine oil for a turbine of a jet engine, comprising:

a base oil (A) comprising a polyol ester (A1);

an antioxidant (B) comprising an amine-based antioxidant (Bp;

a polymethacrylate (C) having a weight average molecular weight of from 150,000 to 500,000;

an alkyl aromatic compound (D), wherein a content of the polyol ester (A1) in the base oil (A) is from 80 to 100% by mass based on a total amount of the base oil (A), a content of the base oil (A) is from 70 to 90% by mass based on a total amount of the turbine oil, a content of the amine-based antioxidant (B1) in the antioxidant (B) is from 70 to 100% by mass based on a total amount of the antioxidant (B), a content of the antioxidant (B) is from 0.1 to 5% by mass based on the total amount of the turbine oil, a content of the polymethacrylate (C) in terms of resin content is from 0.5 to 5.0% by mass based on the total amount of the turbine oil, and a content of the alkyl aromatic compound (D) is from 110 parts by mass to 800 parts by mass per 100 parts by mass, based on a total resin content of the polymethacrylate (C), the polyol ester (A1) is an ester of a hindered polyol represented by the following formula (a-1') with an aliphatic monocarboxylic acid;

(a-1')

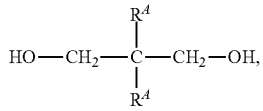

wherein $R^A$ each independently represent a monovalent hydrocarbon group having 1 to 6 carbon atoms or a methylol group (—$CH_2OH$), the amine-based antioxidant (B1) consists of a combination of a naphthylamine (B11) and a diphenylamine (B12), a content ratio of the naphthylamine (B11) and the diphenylamine (B12), ((B11)/(B12)), by mass is from 55/45 to 80/20, the polymethacrylate (C) has a molecular weight distribution, Mw/Mn, of 3.7 or less, the alkyl aromatic compound (D) consists of an alkylbenzene, an alkylnaphthalene, or a combination thereof, and wherein the turbine oil satisfies the following conditions (1) and (2):

(1): a viscosity index is 140 or more; and (2): a coking amount attached to a panel is 80 mg or less after continuously performing a panel coking test for 6 hours according to Fed. Test Method Std. 791-3462 under a condition of a panel temperature of 320° C. and an oil temperature of 130° C., and in a cycle of a splash time of 15 seconds and a suspend time of 30 seconds, wherein a Brookfield viscosity (BF) of the turbine oil at −40° C. is from 9,000 to 25,000 mPa·s.

2. The turbine oil according to claim 1, wherein a content of the alkyl aromatic compound (D) is from 0.1 to 17% by mass based on the total amount of the turbine oil.

3. The turbine oil according to claim 1, wherein a content of metal atoms is less than 100 ppm by mass based on the total amount of the turbine oil.

4. The turbine oil according to claim 1, wherein a content of an ashless dispersant is less than 0.1% by mass based on the total amount of the turbine oil.

5. A method comprising lubricating a turbine of a jet engine with a turbine oil, the turbine oil comprising:

a base oil (A) comprising a polyol ester (A1);

an antioxidant (B) comprising an amine-based antioxidant (B1);

a polymethacrylate (C) having a weight average molecular weight of from 150,000 to 500,000; and an alkyl aromatic compound (D), wherein a content of the polyol ester (A1) in the base oil (A) is from 80 to 100% by mass based on a total amount of the base oil (A), a content of the base oil (A) is from 70 to 90% by mass based on a total amount of the turbine oil, a content of the amine-based antioxidant (B1) in the antioxidant (B) is from 70 to 100% by mass based on a total amount of the antioxidant (B), a content of the antioxidant (B) is from 0.1 to 5% by mass based on the total amount of the turbine oil, a content of the polymethacrylate (C) in terms of resin content is from 0.5 to 5.0% by mass based on the total amount of the turbine oil, and a content of the alkyl aromatic compound (D) is 2=54 from 110 parts by mass to 800 parts by mass per 100 parts by mass, based on a total resin content of the polymethacrylate (C), the polyol ester (A1) is an ester of a hindered polyol represented by the following formula (a-1') with an aliphatic monocarboxylic acid:

(a-1')

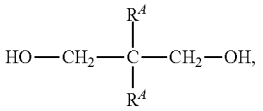

wherein $R^A$ each independently represent a monovalent hydrocarbon group having 1 to 6 carbon atoms or a methylol group (—$CH_2OH$), the amine-based antioxidant (B1) consists of a combination of a naphthylamine (B11) and a diphenylamine (B12), a content ratio of the naphthylamine (B11) and the diphenylamine (B12), ((B11)/(B12)), by mass is from 55/45 to 80/20, the polymethacrylate (C) has a molecular weight distribution, Mw/Mn, of 3.7 or less, the alkyl aromatic compound (D) consists of an alkylbenzene, an alkylnaphthalene, or a combination thereof, and wherein the turbine oil satisfies the following conditions (1) and (2):

(1): a viscosity index is 140 or more; and (2): a coking amount is 80 mg or less after continuously performing a panel coking test for 6 hours according to Fed. Test Method Std. 791-3462 under a condition of a panel temperature of 320° C. and an oil temperature of 130° C., and in a cycle of a splash time of 15 seconds and a suspend time of 30 seconds, wherein a Brookfield viscosity (BF) of the turbine oil at −40° C. is from 9,000 to 25,000 mPa·s.

6. The turbine oil according to claim 1, wherein a content of the alkyl aromatic compound (D) is from 1.5 to 15% by mass based on the total amount of the turbine oil.

7. The turbine oil according to claim 1, wherein the content of the polymethacrylate (C) in terms of resin content is from 0.8 to 3.5% by mass based on the total amount of the turbine oil.

8. The turbine oil according to claim 1, wherein the BF viscosity of the turbine oil at −40° C. is from 9,000 to 23,000 mPa·s.

9. The method according to claim 5, wherein a content of the alkyl aromatic compound (D) is from 1.5 to 15% by mass based on the total amount of the turbine oil.

10. The method according to claim 5, wherein the BF viscosity of the turbine oil at −40° C. is from 9,000 to 23,000 mPa·s.

* * * * *